US005533229A

United States Patent [19]

Hahn

[11] Patent Number: 5,533,229

[45] Date of Patent: Jul. 9, 1996

[54] DEVICE FOR REMOVING HAIR FROM HAIRBRUSHES

[76] Inventor: Winfried Hahn, Elzer Strasse 7, D-65555 Limburg, Germany

[21] Appl. No.: 300,712

[22] Filed: Sep. 2, 1994

[30] Foreign Application Priority Data

Sep. 8, 1993 [DE] Germany ..... 43 30 343.9

[51] Int. Cl.[6] ..... A46B 17/06

[52] U.S. Cl. ..... 15/310; 15/142; 15/353

[58] Field of Search ..... 15/310, 311, 143, 15/353

[56] References Cited

U.S. PATENT DOCUMENTS

| | | | |
|---|---|---|---|
| 1,014,027 | 1/1912 | Walter | 15/353 |
| 2,779,046 | 1/1957 | Queirolo | 15/310 |
| 2,867,231 | 1/1959 | Gerstmann | 15/353 X |
| 3,056,993 | 12/1962 | Lewis | 15/310 |
| 3,066,345 | 12/1962 | Kasper | 15/310 |
| 3,137,023 | 6/1964 | Klinge et al. | 15/310 |
| 3,217,349 | 11/1965 | Hull et al. . | |
| 3,377,646 | 4/1968 | Von Werder . | |

*Primary Examiner*—Chris K. Moore
*Attorney, Agent, or Firm*—Paul & Paul

[57] ABSTRACT

A device for removing hair from hairbrushes having a housing with an inlet opening and a suction outlet connectable to a suction device. A Deflector device is arranged between the inlet opening and suction outlet in such a way that it blocks direct passage from the inlet opening to the suction outlet, and which forms a friction surface. Hair makes contact with the friction surface when sucked into the device. By pulling the brush away from the device, hair may then be pulled out of the brush.

11 Claims, 2 Drawing Sheets

DEVICE FOR REMOVING HAIR FROM HAIRBRUSHES

Figure 1:
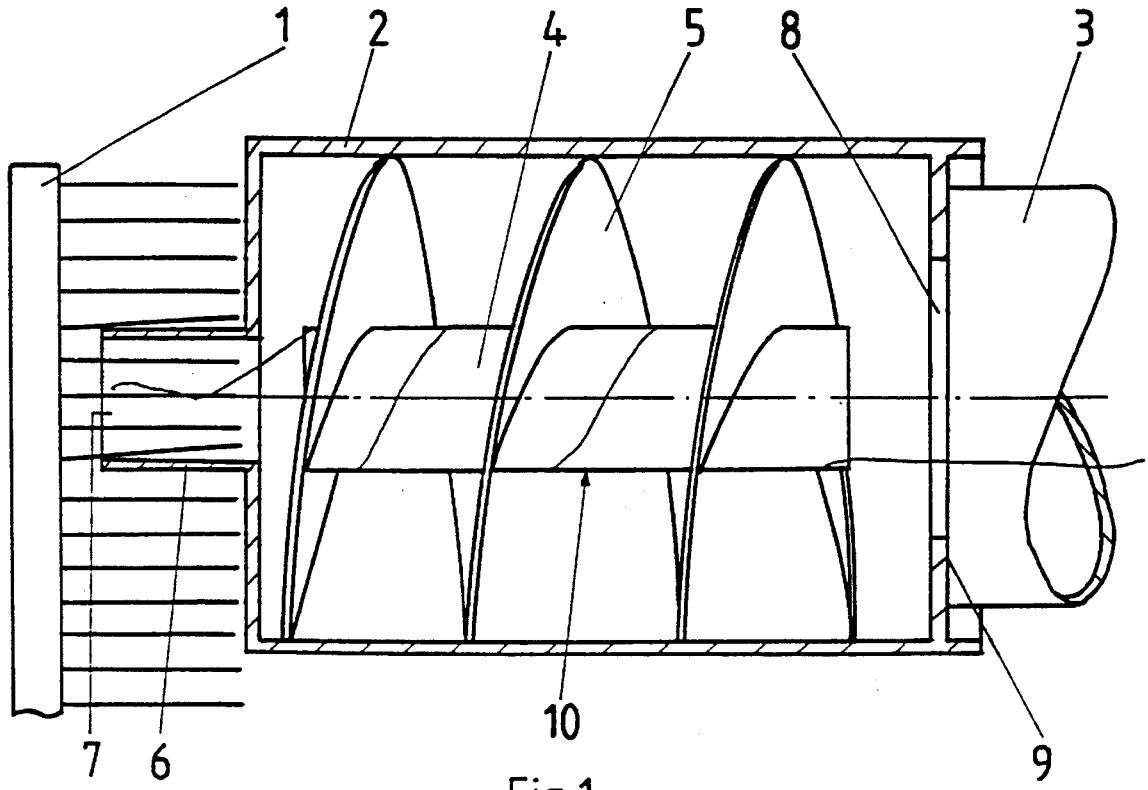

It is, of course, very difficult to remove hair from hairbrushes. A second brush or a comb is usually used to clean a hairbrush. When this is done, the hair is firstly transferred from the brush to the cleaning brush or comb, in order to then be removed by hand.

To really clean hairbrushes thoroughly, tweezers have to be used to remove the last hairs. Therefore, cleaning a hairbrush thoroughly is very time-consuming and tedious. An additional problem is posed by the tendency which many people have towards taking hold of the hair and tearing it out of a brush.

Cleaning devices described in writings are intended to adhere to the hair as they strip through the brush, and then firmly take hold of it. The firmly held hair is then taken from the cleaning device by hand. Due to the small diameter of a hair, such adhering and holding of hair by mechanical means is a technical problem which can only be overcome with difficulty. Currently, no device exists on the market which will permit simple, fast and thorough cleaning of a hairbrush.

The aim of the present invention is to design a device for cleaning hairbrushes which satisfies requirements of universal application for all types of hairbrush, of simplicity in its use without individual hairs having to be looked for, of fast and thorough cleaning, and of simple removal of hair from the cleaning device, if possible without the hair having to be held.

The problem posed is solved by the features of claim 1, and is further developed and designed by the features of the other claims.

The suction opening of the device according to the invention is to be connected, or is connected, to a suction device. Usually, this suction device is a vacuum cleaner. However, the suction device can also be in the form of a fan which is fitted into the device and which is actuated either by an electric cable, an accumulator or a battery.

In the first case, the suction opening of the device is placed on the suction pipe of the vacuum cleaner, wherein it is placed firmly against this opening of the suction pipe. Therein, according to an expedient embodiment of the invention, the suction opening can be surrounded by a flat surface which rests flat on the suction pipe of the vacuum cleaner. Instead of this, the suction opening of the device according to the invention, or the device as a whole according to a preferred embodiment, can also be surrounded by a cone which tapers towards the suction opening, which cone is inserted into the opening of the suction pipe of the vacuum cleaner and is firmly clamped there by virtue of its conical shape.

If the suction device is a fan which is fitted into the device, the fan is arranged in the housing of the device itself. In this case, it is expedient to provide a filter device between the suction opening and the fan to block the cross-section of the housing, on which filter device the sucked in hair will collect.

The hairbrush to be cleaned is brought to the inlet opening of the device, and the hair is sucked in. Some of the hair is taken away by the air flow and is sucked into the vacuum cleaner or onto the hair filter. The rest of the hair is, however, only sucked into the parts which are not stuck or clamped to the brush, and is partly drawn into the device. The flow forces attacking the hair are not sufficient here to completely suck up the hair. This is so particularly if the hair is sticking to the brush with residues of hairspray or setting lotion. Since some of the hair is completely sucked up and some is only partly sucked in, the brush is again removed from the device. When this is done, the hair is held to the friction surfaces of the deflector device. By pulling the brush away, the hair is then pulled out of the brush and is completely sucked up. The process is repeated about ten times over the rest of the brush, wherein each cleaning process lasts about one second. After a few seconds, the brush is therefore completely cleaned, without the person using the device having had to take hold of, or look for, one single hair. As mentioned hereinabove, the device is sucked into the suction opening by the reduced pressure. The suction force is always significantly greater than the tractive force required to pull the hair from the hair brush. In the case of a vacuum cleaner being used as the suction device, this ensures that the device is not released from it during operation.

For reasons of cost, it is preferable if all embodiments of the invention are made of plastics material.

The purpose of the deflector devices in the device according to the invention is, after the ends of hair have been sucked in, when the inlet opening is being removed from the brush, to take firm hold of the sucked up hair ends and thereby pull the hairs from the brush. To this end, in the regions of the deflector devices where contact is made by the hair after it has been sucked in, the deflector devices must not be smooth but must form a friction surface. This friction surface can be formed by the material of the deflector devices itself, e.g. by a roughening of the surface, particularly if the deflector devices are made of plastics material. Instead of this, the deflector devices can have a friction lining in the regions mentioned, e.g. a lining of rubber or plastics material which increases the adhesive action of the deflector devices.

The deflector devices themselves can vary in design. By way of example, and preferably, they can be in the form of a spiral configuration arranged stationarily in the housing. This has the effect that when the hair is sucked through by air, it is not able to reach the suction opening along the direct route, but is guided along the turns of the spiral configuration, and therein comes to lie on the shaft of the spiral configuration which is provided with the friction surface.

Instead of this, according to another preferred embodiment, the deflector devices can be in the form of rebound walls which are fixed at spacings apart, alternatingly on mutually opposite regions of the inner wall of the housing, the free ends of the rebound walls overlapping with each other. In this way, baffles are produced which deflect the sucked up hair alternatingly into either direction away from the direct route to the suction opening, wherein the hair always comes to rest at the free ends of the rebound walls or deflector plates. In order to increase the friction surface there, it is expedient to bend over the free ends of the rebound walls away from the inlet opening towards the suction opening, expediently with a constant curvature.

To obtain the effect of the invention, it is sufficient if the contact regions of the deflector devices are designed at least partially as friction surfaces. For manufacture-related reasons, however, it can be expedient to design the entire deflector devices as such a friction surface, even if part of the friction surface is not used according to the invention.

Useability of the device according to the invention is even further promoted if a projecting member is provided in the region of the inlet opening, by means of which projecting member the hair can be loosened in the brush.

Figure 2:
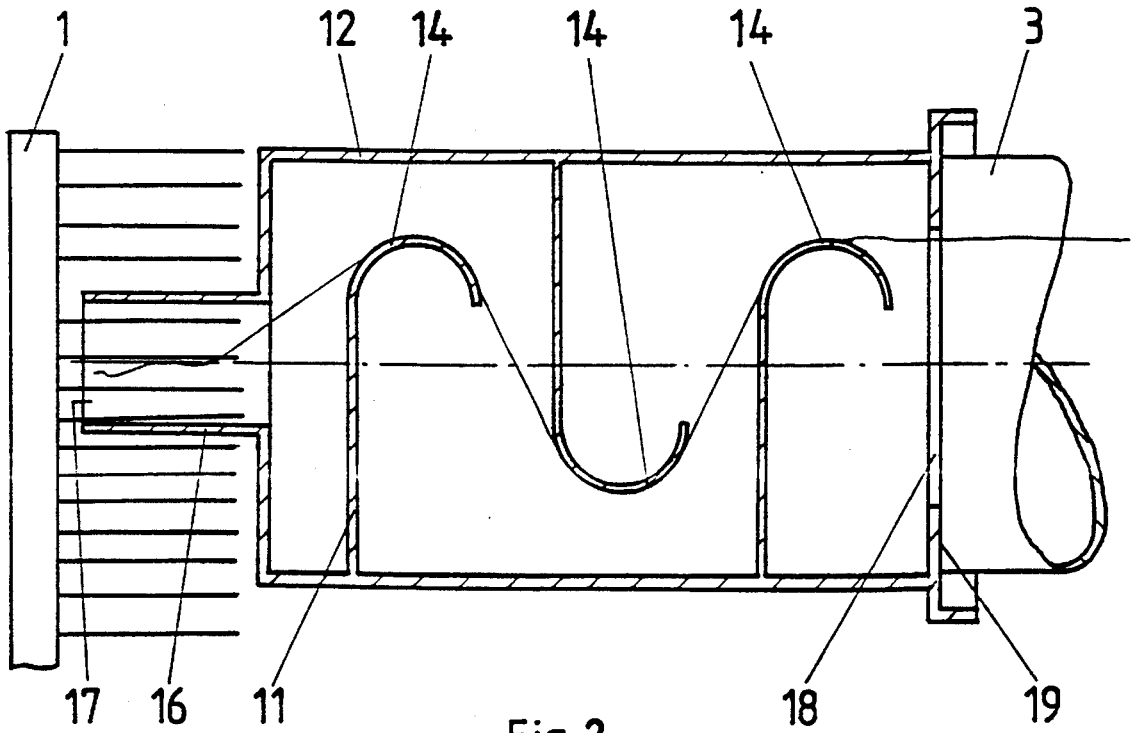
Figure 3:
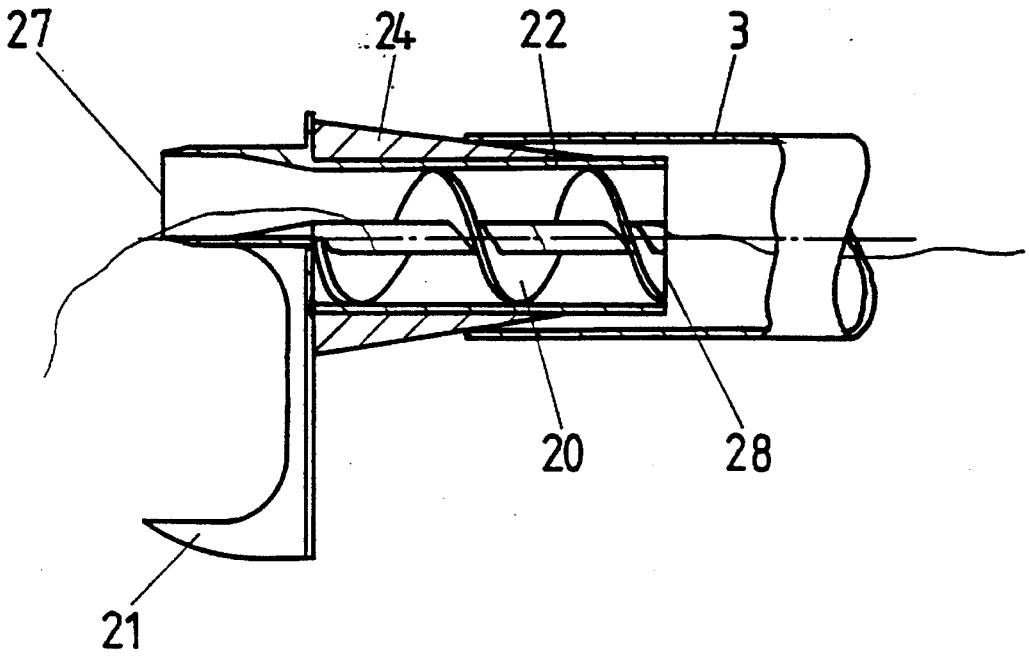
Figure 4:
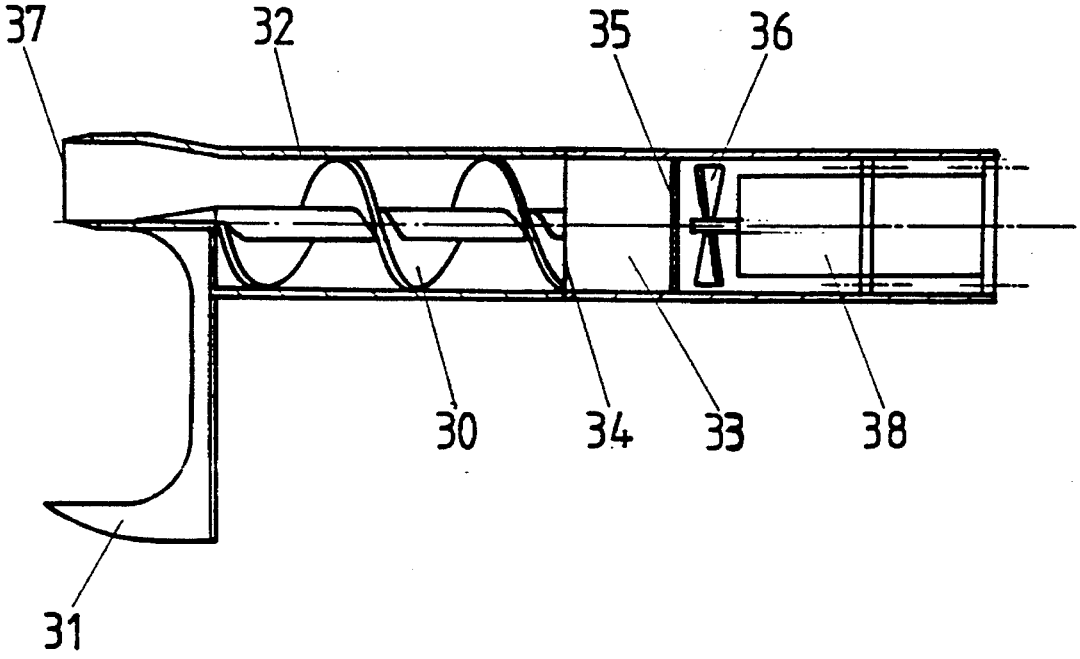

The invention will be described with the aid of the drawings, wherein:

FIG. 1 is a vertical section through a first embodiment according to the invention with a brush placed on it and with a suction pipe placed on it, according to the principle of rope friction, wherein the hair is wound around the shaft of the spiral configuration during the sucking in operation, FIG. 2 is a vertical section through another embodiment according to the invention with a brush and a suction pipe placed on it, wherein the hair comes to lie on the friction surfaces during the sucking in operation, FIG. 3 is a vertical section through another embodiment according to the invention, with a projecting member, and FIG. 4 is a vertical section through another embodiment according to the invention with a fan for the sucking in operation.

The embodiment, shown in FIG. 1, of a device according to the invention is shown in vertical section with a brush 1 placed on it to the left and with a suction pipe 3 of a vacuum cleaner placed on it to the right (shown in a broken away condition). The device consists of a housing 2 with an inlet nozzle 6, at the free end of which is an inlet opening 7. The suction opening 8 is surrounded by a flat surface 9 on which the free end of the suction pipe 3 of the vacuum cleaner is placed and which produces sufficient suction when air sucked through to permit use of the device.

Disposed inside the housing 12 is a non-rotatable, stationarily arranged spiral configuration 10, e.g. of plastics material or metal, with a shaft 4 and spiralling vanes 5. At least the surface of the shaft 4 is provided with a friction surface which firmly holds the hairs which are partly firmly held in the brush and partly sucked up.

Another embodiment is shown in FIG. 2, likewise in vertical section, with a brush 1 placed on it and with the suction pipe 3 of a vacuum cleaner placed on it.

The housing 12 of this embodiment, in turn, contains an inlet nozzle 16 with an inlet opening 17 and a suction opening 18 which is surrounded by a flat surface 19. Fixed inside the housing 12 in mutually oppositely disposed regions of the inner wall are rebound walls 11 which block about ⅔ of the cross-section of the inside of the housing 12 and which overlap with each other in the central region of the housing, so that the hair is deflected through this labyrinth-like arrangement, alternatingly in either direction, away from the central line of the device. The free ends of the rebound walls 11 are bent over from the inlet opening towards the suction opening, in order to increase the contact surface for contact with the sucked in hair, and in these semi-circular bent over regions 14, at least, the rebound walls form friction surfaces.

FIG. 3 shows a similar device to that in FIG. 1 which contains a non-movable spiral configuration 20 which is stationarily arranged in a housing 22. The inlet opening 27 is disposed at one end of the device, in the region of which inlet opening a projecting member 21 is also provided to loosen the hair in the brush. The housing 22 is surrounded by a conical tubular piece made of a resilient material which tapers towards the suction opening and which is inserted into the free end of the suction pipe 3 of a vacuum cleaner, and which ensures a good seating for the device during use by virtue of the clamping forces occurring.

The embodiment of the invention shown in FIG. 4 consists of a tubular housing 32 with an inlet opening 37 and a projecting member 31 in the vicinity thereof to loosen the hair. Inside the housing is a stationary spiral configuration 30 which acts as the deflector devices, at the end of which spiral configuration is an adjacent chamber 33. The intake into this chamber from the region of the housing in which the spiral configuration 30 is disposed is to be regarded as the suction opening 34. In this case, the device is not connected to a vacuum cleaner, but contains a fan 36 with a motor 38, which is acutated either by a battery or by an electric cable. Between the chamber 33 and the fan 36 is a hair filter 35 which blocks the cross-section of the housing 32, on which hair filter the hair sucked out from the chamber 33 collects. Hair is removed from the chamber 33 and from the hair filter 35 from time to time by removing the left part of the housing with the spiral configuration 30 from the right part of the housing with the fan 36 and the chamber 33. This embodiment is advantageous in that it is independent of a vacuum cleaner, and, in the case of battery operation, is independent of a power supply.

The mode of operation of the embodiments shown in FIGS. 1 and 2 is as follows:

With the embodiment according to FIG. 1, the housing 2, as already mentioned, is placed on the end piece 3 of the vacuum cleaner pipe and suction takes placed by reduced pressure. When the brush 1 is brought towards it, all the hair sucked in is wound around the shaft 4 since the air flow is guided through the spirally winding surface of the vane 6 likewise about the axis 4. All hair which is only loosely joined to the brush is immediately sucked up completely. The rest remains on the surface of the shaft 4. Whilst the brush 1 is being removed from the device, the hair which is wound around the shaft 4 is firmly pulled. When the brush 1 is removed further from the device, the hair is removed from the brush.

If the hair is wound around the shaft several times, the system is "self-locking", i.e. when the motor of the vacuum cleaner is running, the hair can no longer be pulled from the device, without tearing. This self-locking occurs as soon as the hair is wound around the brush more than 1.5 times, if the surface of the shaft 4 is made of a soft rubber. When a number of hairs are sucked up into the device, with suitable application of force, the entire device may possibly be separated from the reduced pressure force of the vacuum cleaner pipe. This is an important safety aspect with respect to unauthorised use by children.

The same operating principle forms the basis of the device according to FIG. 2 as that in FIG. 1. Here, the sucked in hair is guided over surfaces 14, ideally surfaces with rubber, whilst the air flow is deflected appropriately. Here too, the frictional forces which act upon the hair during removal of the brush give rise to friction between the hair and friction surface, whereby the hair is pulled out of the brush.

I claim:

1. A device for removing hair from hairbrushes, comprising a housing with an inlet opening and a suction outlet connectable to a suction device, and also with at least one deflector device disposed between the inlet opening and the suction outlet to block direct passage over the shortest route from the inlet opening to the suction outlet, said deflector device having a friction surface, with which contact is made by the hair during the sucking in of the hair by the device.

2. A device according to claim 1, wherein the suction outlet is surrounded by a flat surface.

3. A device according to claim 1, wherein the suction outlet is surrounded by a cone which tapers towards the suction outlet.

4. A device according to one of claims 1 to 3, wherein the deflector device are spiral configuration arranged stationarily in the housing (2, 22, 32).

5. A device according to one of claims 1 to 3, wherein the deflector device are rebound walls which are fixed at spacings apart, alternatingly on mutually opposite regions of the inner wall of the housing, the free ends of the rebound walls overlapping with each other.

6. A device according to claim 5, wherein the free ends of the rebound walls have sections which are bent over from the inlet opening towards the suction outlet.

7. A device according to one of claims 1 to 3, including a projecting member extending from the housing to a position proximate the inlet opening.

8. A device according to one of claims 1 to 3, wherein the housing contains the suction device, connected to the suction outlet.

9. A device according to claim 8, wherein the housing contains a hair filter between the suction outlet and the suction device.

10. A device according to one of claims 1 to 3 wherein the deflector device are made of plastics material.

11. A device according to one of claims 1 to 3, wherein the deflector device has a friction lining.

* * * * *